US006369707B1

(12) United States Patent
Neer

(10) Patent No.: US 6,369,707 B1
(45) Date of Patent: Apr. 9, 2002

(54) SPECIFIC LOCATION PUBLIC ALERT RECEIVER

(76) Inventor: Dana L. Neer, 814 Eagle La., Apollo Beach, FL (US) 33572

( * ) Notice: Subject to any disclaimer, the term of this patent is extended or adjusted under 35 U.S.C. 154(b) by 0 days.

(21) Appl. No.: 09/854,080

(22) Filed: May 11, 2001

Related U.S. Application Data

(63) Continuation-in-part of application No. 09/327,520, filed on Jun. 8, 1999.

(51) Int. Cl.[7] ..... G08B 1/08
(52) U.S. Cl. ..... 340/539
(58) Field of Search ..... 340/538, 533, 340/539, 310.01, 286.02

(56) References Cited

U.S. PATENT DOCUMENTS 5,086,385 A 2/1992 Launey et al.
5,400,246 A * 3/1995 Wilson et al. ..... 340/825.06 X

* cited by examiner

*Primary Examiner*—Daryl Pope
(74) *Attorney, Agent, or Firm*—Larson & Larson, P.A.; James E. Larson

(57) ABSTRACT

Disclosed is a specific location public alert device requiring no specialized installation which may be plugged into any household electrical outlet. The device requires no switch for activation or its alert, which may be a tone, light, or voice, and is activated by an incoming transmission from an authorized transmitting source in the specific area of the device(s), such as cell phone towers, and activates any number of devices within one home or all homes simultaneously. The device may be mobile and removable from the outlet and powered by replaceable or rechargeable batteries at alternate remote locations, such as a cigarette lighter adaptor within a vehicle. The device may be preset to one or more common frequencies determined by the civil authorities from any location worldwide authorizing or transmitting a signal on an emergency frequency from specifically located transmitters in the location or path of the public emergency or warning.

20 Claims, 1 Drawing Sheet

SPECIFIC LOCATION PUBLIC ALERT RECEIVER

PRIOR APPLICATIONS

This application is a continuation-in-part of U.S. application Ser. No. 09/327,520, filed on Jun. 8, 1999.

BACKGROUND OF THE INVENTION

1. Field of the Invention

This invention relates to public warning of impending danger. More particularly, it relates to an apparatus capable of receiving a transmitted signal having a warning message embedded thereon and converting the warning message into an audio and/or visual warning signal for a person in a specific area.

2. Description of Prior Art

The prior art related to this invention is known to be general public warning systems that alert an entire community, although in many applications, the entire community is notified of the possible most hazardous locations. These warnings are produced in the following manners:

(1) a hand held radio, although economical to purchase, it must be turned on to warn the user;

(2) an electric radio design that may be activated by means of the broadcast system or in association with the National Weather Service; these radios may be activated when the on/off switch is in the off position, however they are much more costly, and therefore, limit the user's ability to purchase, and also limiting the number of radios one can afford, thereby restricting the area of a building or location the warning may be received by persons in the threat of danger; and (3) community sirens, which may alert the community along with the television, computer, and similar warning systems.

The major problems associated with these systems are that they alert an entire large area, much of which is not affected by the hazard. This results in the community becoming complacent of the repeated warnings that seldom develop near them, resulting in persons ignoring the warnings. Also, in many cases, some people do not have a television or radio on, particularly, during the night-time hours, or may be watching or playing with a video movie or game, and therefore, do not receive the warning.

SUMMARY OF THE INVENTION

This invention teaches a means of alerting persons of impending danger as related to civil defense, National Weather Service Warning, and any general threat to the public. This alert in one embodiment is a receiver that is economical enough to install in a substantial number of locations within a home or building, and that may plug into any standard electrical outlet and have a low power usage back up source.

This invention also teaches activating the receivers directly in the path, in the immediate area, or in a potential area as may be required by receiving a transmission from cellular communication towers, for example, or other similar means directly in the areas required.

The present invention assists in minimizing the complacency that accumulates in communities where general alerts are issued and seldom affect the entire alerted community. It also provides an economical and practical means of alerting persons, especially children and the elderly, that may be utilizing a television for video movies or games, and/or not have any notification means turned on or tuned in as would be required to receive an alert, to be alerted any time of the day or night, even if the parents are not available to provide directive procedures or precautions as required. This device can also be used for alerting persons that may be deaf or possess other handicaps by flashing lights or any variety of signaling means.

The invention renders a design and means economical enough to be afforded by any persons and/or supplied by civil entities where automatic activated radio receivers or other known means are too expensive for mass populations.

The invention can alternately be used as a means of alerting a user of a mobile cellular or digital phone that may be driving into an area of danger. Further, one or more of the household devices may be taken to sporting, camping, family outings or functions, and may be powered by a replaceable or rechargeable battery or any means of connecting to a vehicle. The invention can also be adapted for connection to a telephone or any desired circuitry entering a building, etc., that may be activated by any utility such as a telephone, cable or satellite television, computer, electrical power utilities, or any entities that have means to activate the invention by electrical pulsing, reverse 911 calling, computer activation transmitting, or any known means that may activate the invention related to the method of means available to a particular utility or entity.

The object of the invention is for use as a primary receiver that may transmit to any number of secondary receivers with less costly circuitry, yet can provide an alert signal to persons in the area. The invention can be utilized as a surge protector, or a circuit breaker means that has a proper functioning indicator and testing means, and may have the circuit monitored by the alert signaling entity by means of signaling the user of a non-active device or means of resetting the circuit breaker manually or by means from the alerting entity.

In the preferred embodiment, the system or device is installed by means of plugging into an electrical outlet, and or can be jointly or independently battery powered, and is activated by means of current cellular phone technology or other current means that is capable of transmitting any desired signal or transmission known, or those emerging compatible types of technology that can be adapted to this device, and transmitted from locally placed transmission or cell phone towers, or any other antennas or compatible transmitting systems. Also, the warning signal may be transmitted on specific frequencies for specific areas or warning requirements or any similar means rendering the same results. Types of wireless signals include, but are not limited to, cellular telephone, radio frequencies, Loran, analog cordless telephone, digital enhanced cordless telephone, general public radio service, shared wireless access protocol, high sped circuit switch data, universal mobile telecommunications, enhanced data rate for GSM evolution, global positioning satellite and standard satellite signals. Types of carrier line signals include, but are not limited to, utility power lines, telephone lines, DSL, cable and fiber optic lines.

When a warning is desired to be transmitted to a specific area regardless of size, the proper authorities cause the system to transmit a signal to the devices desired, and the device warns or alerts any persons within its range by means of a tone, voice, light or any other desired means. The system may include a primary receiving unit or device that may activate additional devices within its range, and that these secondary devices may be manufactured as a less expensive version from the primary unit. This device will enable persons that are not currently watching television, radio, or may be traveling, on camping trips, at sporting events, etc., to be alerted in the case of any civil emergency in their specific area, unlike weather radios which may be of an inexpensive design which are required to be turned on to receive an alert, or an expensive design that may costly, resulting in them being unavailable to many consumers or limited in the number per household, etc., that may leave a number of persons in the household beyond the reach, or unable to take advantage of the warning transmitted, without alerting an entire county or large area causing complacency or unnecessary concern to those persons not affected. Also, as described herein, the present invention will have advantages over local sirens, conventional radio systems or telephone systems by being located in the home, office, camper, or any other location that persons may be in, and unable to hear a distant siren or receive a warning by any other means. No radio, telephone, or electrical service need be required, depending on the type of device selected and covered in the description of this invention.

The device could be taken out of a wall electrical outlet and taken anywhere. In this embodiment, the unit could have a snap on cover for the back, and a handle that could double as a brace to standing the unit in a nearly upright position. The rechargeable batteries, and/or replacement batteries would supply power to the device. The unit could be sold or leased to consumers as previously described developing digital TV transmitters or any telecommunication companies or developing means may also be used.

The signal transmitted from the cellular or other tower in the specific locations of the emergency or hazard could also activate cellular telephones that were operating in that area by means of a tone heard only by the customer using the cellular phone. This could either be by a simple tone that the customer would recognize as an emergency signal or it could have a tone or ring, and then the customer could answer or punch a certain number and receive a recorded message of the impending emergency, or the message could appear on the cell phone screen. Another manner of notifying the user of danger could be that future designed cellular telephones could have a system built into them that would turn the telephone on in case of emergency when the phone is not activated at the time, thereby, notifying the user by means of the phone ringing that they are in an area of potential danger. It could also warn cellular phone users of major traffic accidents or delays in specific areas.

An additional embodiment of the invention could be to activate computers by means of an installed processor-receiver or over telephone lines that could flash a message on the computer screen, and/or sound a tone or call the person by ringing the telephone at a specific address, or activate any electrical device within the area by means of being installed to any incoming communication or power source that may simply be plugged into a receiving connection, and any entity that desires to provide service in their particular field of operation may simply send a signal to the device attached to the inlet source to the building or area, and, therefore, the device may by any known means activate an alert within itself or through any device within the area.

An additional system could be attached to a TV set where the antenna or cable is connected, and that system could cause an alert to show up on the screen, regardless of any other activity the TV may be performing.

It is to be noted that the device should be manufactured with a reliable but economical design to make it easily marketable similar to that of a smoke detector that would enable virtually every civilized household in the world to be able to have one or more of these units in the home. This device would be of particular importance to those residents of mobile homes or the elderly that may go to sleep early and not have a radio or television activated, or in the case of minor children that may be left at home while their parents were away at work or at another activity, and therefore, adding peace of mind to the parents that the children would be notified in the case of an emergency without them being there, regardless of what activities the children may be involved in at any given moment.

This system could also be activated if not by means of cellular or other towers, by means of a radio signal transmitted from a police, fire or other emergency vehicle that could travel through a community and broadcast the signal to the specific area where an emergency may be in effect.

Another embodiment which may be considered would be to have a means of selecting a specific frequency by means of a predetermined dial or television station, etc., which could broadcast a signal on different frequencies for different areas of the city or county where the emergency may be in effect. The vast number of current and emerging technologies that may or may not be specified herein, could be applied to the basic concept of a low cost, simple device that can notify persons in one or any number of specific areas of pending danger and other desired notifications. This system can also be scaled up to communicate with an entire building, such as a school, store, factory, office, etc., by the utilization of repeating or activated by a device plugged into the telephone incoming connection to additional devices as the distance or interference in a building may limit the effectiveness of the signal or transmission, and is activated by a 911 dispatcher. This can be accomplished by means of an adapter that plugs into an electrical outlet with a battery reserve that is activated by the same means and may turn on and off repeatedly, or any desired effect activating any electrical device plugged into the device. Also, the device may be the primary receiver and transmit to other devices within a desired range of the primary device. The secondary device may activate independently or adaptively, by modification, or in combination with post manufacturing, communication or activation.

BRIEF DESCRIPTION OF THE DRAWINGS

The invention may be best understood by those having ordinary skill in the art by reference to the following detailed description when considered in conjunction with the accompanying drawings in which.

DETAILED DESCRIPTION OF THE INVENTION

Figure 1:
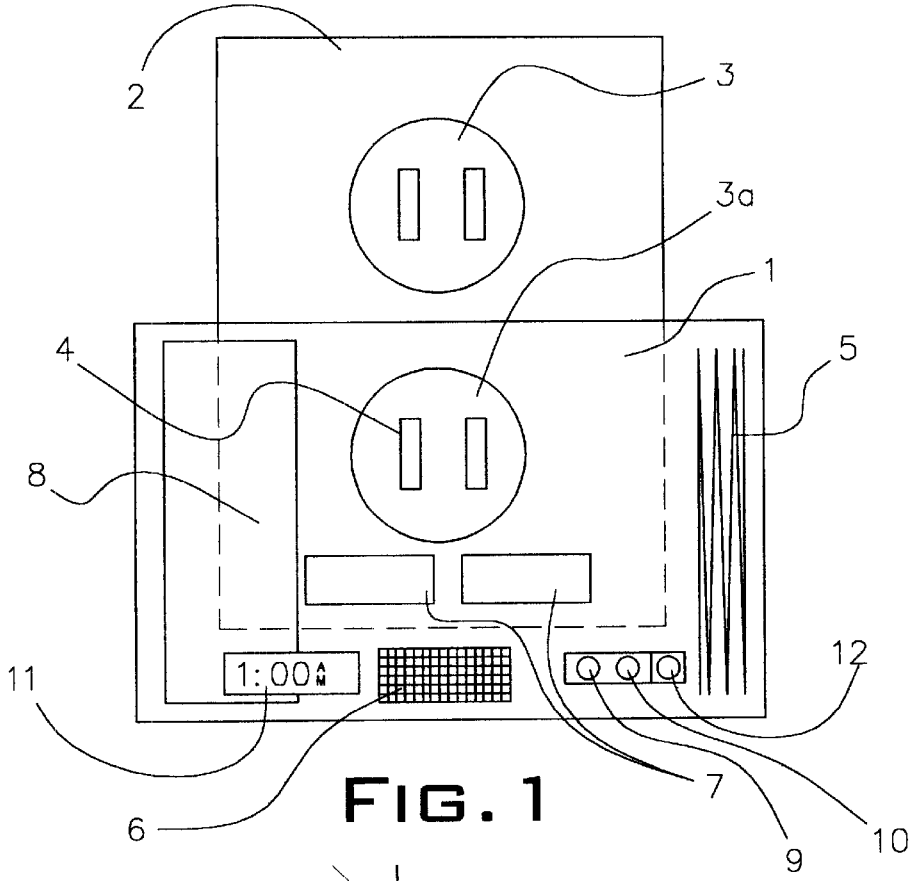
FIG. 1 is a front view of the device plugged into a common household electrical outlet.
Figure 2:
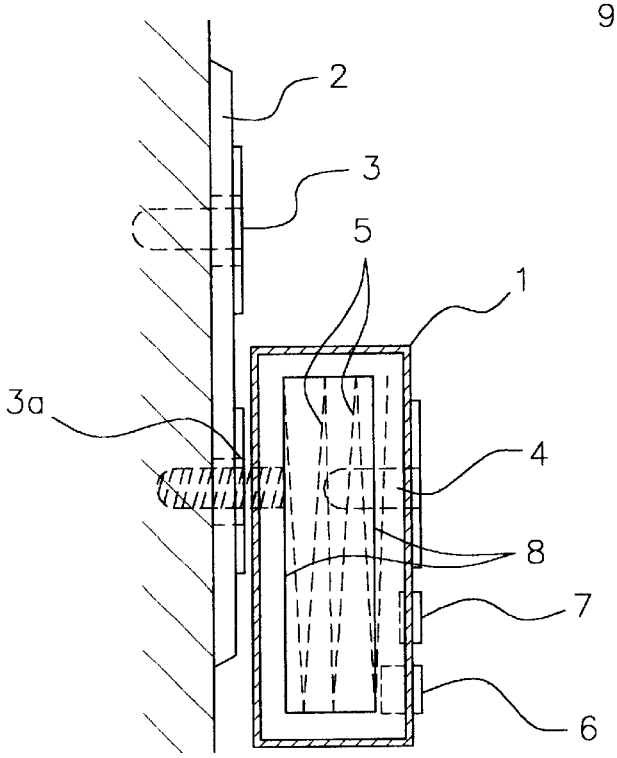
FIG. 2 is a side elevational view of FIG. 1.

FIG. 1 depicts the preferred embodiment of the alert device or system 1 that is plugged into a common household current outlet 2, and is only required to be plugged into one of the outlets 3*a*. There is also an electrical outlet or receiver 4 on the outside face of the warning system 1 to enable it to be used as a standard current outlet. This permits the user to have access to two separate electrical outlets 3 and 3*a* at the same time. The early warning system 1 has an internal antenna 5 which may be of any known design, including but not limited to, an extensively long coil about and within the device enclosure as required for maximum efficiency or may have an antenna that is inserted and extending within the wall void to enhance the abilities to receive a transmission from a cellular phone tower or any other adaptable source in the vicinity of the persons, residence, or business or other location where the system is used or installed. If required, an additional antenna could be adapted to or extended from the device.

Not shown in detail is the internal circuitry system(s)8 which may consist of, but not in any manner limited to, multiple frequency receivers, varied signal filtering means, RDS for changing frequencies, RDS receiver, variable circuitry for enhanced models, low power data receiver, control selection for RDS TMC receivers if all transmissions are standard and activated by means of a major transmitting center as a radio or television or utility of a private corporation transition source, to employ a given number of frequencies for a given area to use standard broadcast and selection means, digital or any other known desired means, means to prevent false signals, adapters for foreign countries' transmitters, multiple antennas or filters means that can be combined in individual devices when manufactured and or installed by desired location, means of an attachable extended battery, cigarette lighter adapter or alligator clip adapter for mobile power source, pager technology for selective transmission to selective region, any means of selectively activating the invention by means of telephone call from 911 despatching centers or other adaptable methods, reprogrammable code safeguard means for preventing tampering from or between transmitter and alert device, stored sent signal indicator-play-back time sent means 11, AC or DC and battery or battery strength indicator 9, surge protection and working order indicator that may employ power manual circuit reset 10, automatic or from a transmitter and or internal primary device means, activation means to towers by satellite, inactive warning beep, signal test indicator 12, activations means by electric pulsing or any known means a power or other utility or other source may employ, as referenced in U.S. Pat. No. 5,303,401—RDS receiver with automatic region recognition means, as referenced in U.S. Pat. No. 5,206,641; adaptable portable traffic congestion radio means, as referenced in U.S. Pat. No. 5,101,510, energy conserving stand-by means, as referenced in U.S. Pat. No. 5,095,532, route selective reproduction means as may be applicable, as referenced in U.S. Pat. 5,345,606, RDS receiver with user definable region filtering as applicable, and means applicable in U.S. Pat. No. 4,476, 582. The aforementioned references are given only for the purpose of specific components utilized in electrical devices that may be installed within this invention or device to enable it to function.

The invention is an affordable emergency alert system that may be purchased in required quantities and placed in a building or areas much as smoke detectors are deployed. The invention may be marketed in a multitude of variable models depending on the consumers and region's requirements and capabilities. There is, therefore, no requirement to manually activate the invention to an "on" or "off" position, nor to purchase expensive radio receivers that may limit alerting capabilities. The invention may be comprised of currently known electrical components and processors 8 that will enable civil authorities, such as the National Weather Service, Fire Department, Police Department, etc., to send specific signals to specific towers in specific locations that will alert persons in such cases as the path of tornadoes, hurricanes, fires, floods, gas leaks, possible danger from criminals in a specific area that may try to break into a home, and any other type of necessary warning, as well as the termination of such a warning. This can be accomplished in a number of manners. One way is directly by the National Weather Service or any other approved agency notifying the owner of the cellular tower or any other tower or transmitter owners or operators in that area or by prearranged means with the owners of the towers, etc., to activate the system for a specific emergency in a specific area. The specific emergency can be either broadcast by means of a tone through speaker 6 and/or flashing light 7 or different tones for different emergencies or different colored lights that would alert the resident by means of verbally telling the user of the specific emergency, or by means of turning on specific lights in a building by means of the light being plugged into the device, or by means of a micro-processor/transmitter for the lighting system on the interior or exterior in the place the unit is located. Also, the invention may consist of a primary receiver with enhanced capabilities that can communicate with additional secondary same type devices with less features within the same area.

This invention could be made extremely economical or could include an enhanced models. It may also have an internal rechargeable battery which would constantly be kept up to full power by means of being plugged into standard receptacles 2 when the power was on 3*a,* and, therefore, be able to be activated if the power was off and an emergency was to occur. There could also be one more expensive unit in the home that would handle the primary functions, and, therefore, make available less expensive units in other areas, such as other rooms, children's bedrooms or other areas of the home. The main early warning system device 1 would activate the other entities by means of transmitting at a lower power.

Equivalent elements can be substituted for the ones set forth above such that they perform the same function in the same way for achieving the same result.

Having thus described the invention what is claimed and desired to be secured by Letters Patent is:

1. A transmitted signal receiving apparatus for alerting persons of impending danger comprising:

a) a housing including a front and back side;

b) a receiver disposed within the housing for receiving a transmitted signal;

c) the transmitted signal having a warning message imbedded thereupon;

d) an electrical plug projecting from the housing back side and capable of inserting within an AC receptacle of a common power scheme for providing an AC power source to the apparatus;

e) an AC to DC power converter disposed within the housing for converting the AC power source to a DC power source, the DC power source electrically coupled to the receiver;

f) signal converter means disposed within the housing for extracting the imbedded warning message from the transmitted signal, the signal converter means electrically coupled to the DC power source and the receiver; and g) alerting means disposed proximal to the housing for indicating a perceivable warning in response to the extracted imbedded warning message.

2. The apparatus of claim 1, further comprising an antennae electrically coupled to the receiver and the DC power source.

3. The apparatus of claim 2, wherein the transmitted signal is a wireless signal.

4. The apparatus of claim 3, wherein the wireless transmitted signal is chosen from the group including cellular telephone, radio frequencies, Loran, analog cordless telephone, digital enhanced cordless telephone, general public radio service, shared wireless access protocol, high speed circuit switch data, universal mobile telecommunications systems, enhanced data rate for GSM evolution, global positioning satellite and standard satellite signals.

5. The apparatus of claim 1, wherein the transmitted signal is transmitted over a carrier line chosen from the group including utility power, telephone, DSL, cable and fiber optic lines.

6. The apparatus of claim 1, wherein the alerting means is chosen from the group including an audio speaker and at least one light source.

7. The apparatus of claim 6, wherein the audio speaker generates a tone signal in response to the apparatus receiving the transmitted signal imbedded warning message.

8. The apparatus of claim 6, wherein the audio speaker generates a digital voice signal in response to the apparatus receiving the transmitted signal imbedded warning message.

9. The apparatus of claim 6, wherein an audio speaker and at least one light source are disposed along the housing front side.

10. The apparatus of claim 1, further comprising an AC power receptacle disposed along the housing front side and electrically coupled to the electrical plug.

11. The apparatus of claim 1, further comprising a plurality of visual indicators including an apparatus power indicator, an apparatus power reset indicator, a transmitted signal test indicator, and a transmitted signal time sent indicator.

12. The apparatus of claim 1, wherein the apparatus is a primary receiving unit having a transmitter disposed within the housing, the transmitter electrically coupled to the signal converter means and the DC power source, the primary receiving unit capable of transmitting the transmitted signal imbedded warning message to at least one secondary apparatus.

13. The apparatus of claim 1, further comprising battery connection means disposed within the housing, the battery connection means capable of receiving a battery for supplying power to the apparatus when no AC power is supplied to the apparatus.

14. The apparatus of claim 1, further comprising a 12 volt connection means for electrically coupling the apparatus to a 12 volt power supply when the apparatus electrical plug is not inserted within the common power scheme AC receptacle.

15. The apparatus of claim 1, further comprising:

a) surge protection means disposed within the housing for providing electrical surge protection to the apparatus; and b) circuit breaker reset means disposed within the housing for providing a circuit breaker reset to the common power scheme.

16. A transmitted signal receiving apparatus for alerting persons within a specific area of an impending danger, the apparatus comprising:

a) a housing including a front and back side;

b) a receiver disposed within the housing for receiving a wireless transmitted signal;

c) the wireless transmitted signal having a warning message imbedded thereupon;

d) an antennae electrically coupled to the receiver;

e) an electrical plug projecting from the housing back side and capable of inserting within an AC receptacle of a common power scheme for providing an AC power source to the apparatus;

f) an AC to DC power converter disposed within the housing for converting the AC power source to a DC power source, the DC power source electrically coupled to the receiver;

g) signal converter means disposed within the housing for extracting the imbedded warning message from the wireless transmitted signal, the signal converter means electrically coupled to the DC power source and the receiver;

g) an audio speaker for providing an audio warning signal relative to the wireless transmitted signal imbedded warning message, the audio speaker electrically coupled to the signal converter means; and h) at least one light for displaying a visual warning signal relative to the wireless transmitted signal imbedded warning message, the at least one light electrically coupled to the signal converter means.

17. The apparatus of claim 16, further comprising an AC power receptacle disposed along the housing front side and electrically coupled to the electrical plug.

18. The apparatus of claim 16, further comprising battery connection means disposed within the housing and capable of receiving a battery for supplying power to the apparatus when the electrical plug is not inserted within the common power scheme AC receptacle.

19. The apparatus of claim 16, further comprising a 12 volt connection means for electrically coupling the apparatus to a 12 volt power supply when the apparatus electrical plug is not inserted within the common power scheme AC receptacle.

20. The apparatus of claim 16, wherein the apparatus is a primary receiving unit having a transmitter disposed within the housing, the transmitter electrically coupled to the signal converter means and the DC power source, the primary receiving unit capable of transmitting the wireless transmitted signal imbedded warning message to at least one secondary apparatus along the common power scheme.

* * * * *